US005785313A

United States Patent [19]

Shiraishi

[11] Patent Number: 5,785,313

[45] Date of Patent: Jul. 28, 1998

[54] BOWLING GAME BOARD

[75] Inventor: Masami Shiraishi, Chiba, Japan

[73] Assignee: Staff Co., Ltd., Tokyo-To, Japan

[21] Appl. No.: 847,488

[22] Filed: Apr. 25, 1997

[30] Foreign Application Priority Data

Sep. 9, 1996 [JP] Japan ..... 8-010414

[51] Int. Cl.[6] ..... A63D 3/00

[52] U.S. Cl. ..... 273/108.1; 273/118 R; 273/119 R; 273/108

[58] Field of Search ..... 273/108, 108.1, 273/118 R, 119 R, 129 R; 473/83, 103, 104, 105, 107

[56] References Cited

U.S. PATENT DOCUMENTS

| | | | |
|---|---|---|---|
| 751,507 | 2/1904 | Haussmann | 473/103 |
| 2,181,984 | 12/1939 | Warner | 473/107 |
| 2,206,213 | 7/1940 | Weidermann | 473/107 |
| 2,289,421 | 7/1942 | Grieshaber et al. | 473/107 X |
| 2,541,583 | 2/1951 | Hayden | 473/107 |
| 2,626,154 | 1/1953 | Lowry | 473/107 X |
| 3,756,598 | 9/1973 | Maeda | 473/107 |
| 3,857,562 | 12/1974 | Rardon et al. | 473/107 |

*Primary Examiner*—Raleigh W. Chiu

*Attorney, Agent, or Firm*—Oblon, Spivak, McClelland, Maier & Neustadt, P.C.

[57] ABSTRACT

A bowling game board having a base board on the top surface of which a lane is formed for rolling a bowl; a bowler's platform provided on one end of the lane of the base board and attached thereon movably in the width direction of the base board; a bowler doll fixed on the top of the bowler's platform and having an arm which rotates under the restitution force of a spring; a locking part provided in the rear of the arm of bowler doll on the bowler's platform for engagingly locking the tip end of the arm and a push button for disengaging the lock of the locking part; a pin stand part provided on the other end side of the base board; a pin controller for causing pins to stand provided above the pin stand part so as to be able to move upward/downward; and a pin collecting case removably attached on the outer end part of the pin stand part.

8 Claims, 4 Drawing Sheets

BOWLING GAME BOARD

BACKGROUND OF THE INVENTION

1. Field of the Invention

This invention relates to a bowling game board for enjoying playing a bowling game on a table.

2. Description of the Prior Art

Prior art bowling game boards of this kind are known wherein a bowler doll is provided on one end side of a base board on the top surface of which a lane is formed, a pin stand part where pins are arranged is provided on the other end of the base board, and, when the aforesaid bowler doll throws a bowl, the bowl hits pins arrangedly standing on the pin stand part, causing the pins to fall, and if a first throw fails to bring all the pins down leaving some pins unfallen, a second bowl is thrown after the fallen pins among the unfallen-left pins are removed by picking them up manually.

The prior art bowling game boards, however, have problems not only that realism of bowling games is damaged because fallen pins must be removed by picking them up manually in case a first thrown bowl leaves some pins unfallen, but that a straight game cannot be played because standing pins slip out of place or fall down by being touched by a hand at the time of removal, and furthermore that it is troublesome that all pins need be rearranged manually to be stood on the pin stand part when all the pins are brought down by a first throw or after a second throw is finished.

This invention has been made in the light of the aforesaid problems and aims at providing a bowling game board wherein realism of bowling games is not damaged, a second throw can be continued by removing fallen pins rapidly and surely and by resetting the remaining pins as they originally stood, or a game can be resumed by automatically arranging and standing all pins rapidly and precisely after a second throw is finished or all the pins have fallen by a first throw.

SUMMARY OF THE INVENTION

For achieving the aforementioned object, the present invention is characterized in that it comprises; a base board on the top surface of which a lane is formed for rolling a ball; a bowler's platform provided on one end of the lane of the aforesaid base board and attached thereon movably in the width direction of the aforesaid base board; a bowler doll fixed on the top of the aforesaid bowler's platform and having an arm which rotates by means of restitution force of a spring; a locking part provided in the rear of the aforesaid arm of bowler doll on the aforesaid bowler's platform for engagingly locking the tip end of the aforesaid arm and a push button for disengaging the lock of the aforesaid locking part; a pin stand part provided on the other end side of the aforesaid base board; a pin controller which causes pins to stand provided above the aforesaid pin stand part so as to be able to move upward/downward; and a pin collecting case removably attached on the outer end part of the aforesaid pin stand part.

In a second mode of the invention, the aforesaid pin controller is characterised by having guide members standingly provided on both the widthwise sides of the aforesaid pin stand part and a pin arranging device supported by, and movable upward/downward along, the aforesaid guide members; and the aforesaid pin arranging device is characterised by comprising a device body supported by, and movable upward/downward along, guide grooves each formed in the inner side of each of the aforesaid guide members, a pin throw-in case supported via elastic members by, and located in the middle of, this device body and provided with pitfalls formed in its bottom part for allowing the aforesaid pins to pass therethrough longitudinally, and an oscillation generating means for oscillating the aforesaid throw-in case.

In a third mode of the invention, each of the aforesaid pins is characterised by being equipped on its bottom part with a weight and an engagement projection, and engagement holes are characterised by being formed in the surface of the aforesaid pin stand part for causing the aforesaid pins to stand by insertion thereinto of engagement projections of pins coming down from pitfalls of the aforesaid arranging means.

In a fourth mode of the invention, the aforesaid pin stand part is characterised by being formed separately above a base board and attached pivotally to the other end of the aforesaid base board so that the aforesaid pin stand part may tilt toward the aforesaid collecting case.

DETAILED DESCRIPTION OF THE PREFERRED EMBODIMENT

Figure 1:
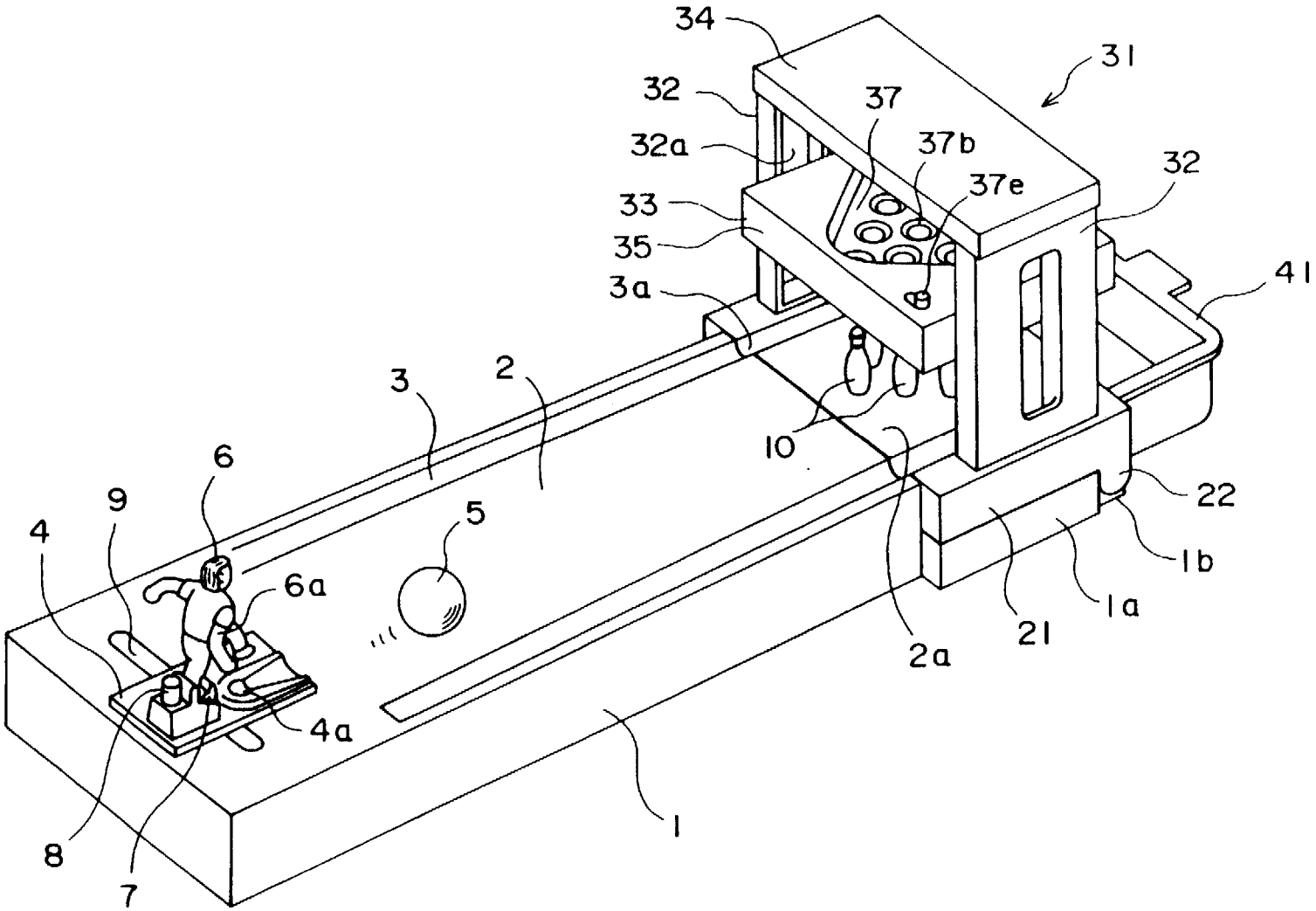
FIG. 1 is a perspective view of a bowling game board for describing an overall outline of a bowling game board according to the present invention.

A form embodying the present invention is now described based on an embodiment shown in the drawings.

FIG. 1 shows a form embodying the present invention and the numeral 1 denotes a base board of a bowling game board, a lane 2 being formed on the top surface of the base board 1, gutters 3 are formed on both side parts of the lane 2. It is preferable that the lane 2 is made of a plastics, a wood, or a metal or the like.

A bowler's platform 4 is provided on one end of the lane 2 and a bowler doll 6 which takes up the stance for throwing a ball 5 is fixed on the top of the bowlwer's platform 4. An arm **6*a* of the bowler doll 6, which is rotatable and attached to its body so as to return to its original state by force of restitution of a spring, makes rotating motion in the direction that extrudes a ball 5 toward the other end of the lane, when a player releases the arm 6*a* of the bowler doll 6 after having rotated it by hand. A ball rest part 4*a* for setting a ball 6 in front of the tip end of the arm 6*a* is also formed on the top of the bowler's platform 4, a locking part 7 is provided in the rear of the ball setting part 4*a* for engagingly locking the tip end of the rotated arm 6*a* of the bowler doll 6, and a push button 8 is provided in the rear of the locking part 7 for releasing the lock of the locking part 7**.

Furthermore, the bowler's platform 4 is put in attachment so as to be able to move along an oblong hole 9 formed in the direction of the width of the lane 2 and also able to make a turn, and a throwing position of the bowler doll 6 is established by fixing the platform 4 to an arbitrary position of the oblong hole 9.

A pin stand part 21 is provided on the other end of the base board 1. A pin controller 31 is provided above the pin stand part 21, and the pin stand part 21 is formed slightly wider than the width of the lane 2 in order to support the pin controller 31 and disposed so as to lie on top of a base board la formed to have the same width as the pin stand part 21. A pin stand surface 2a is continuously flush with the lane 2, and pin stand gutters 3a are continuous with the gutters 3 are formed in the top surface of the pin stand part 21 and an outer end part 22 of the pin stand part 21 is pivotally attached to an outer end part 1b of the base board la so as to be able to rotate. The pin stand part 21 is thereby adapted to be able to rotate toward the other end side of the base board 1. Furthermore, engagement holes 2c (FIG. 2) are formed in the pin stand surface 2a into which engagement projections 10a (FIG. 4) formed on the bottom parts of the pins 10 are inserted when the pins 10 are standingly placed.

Figure 2:
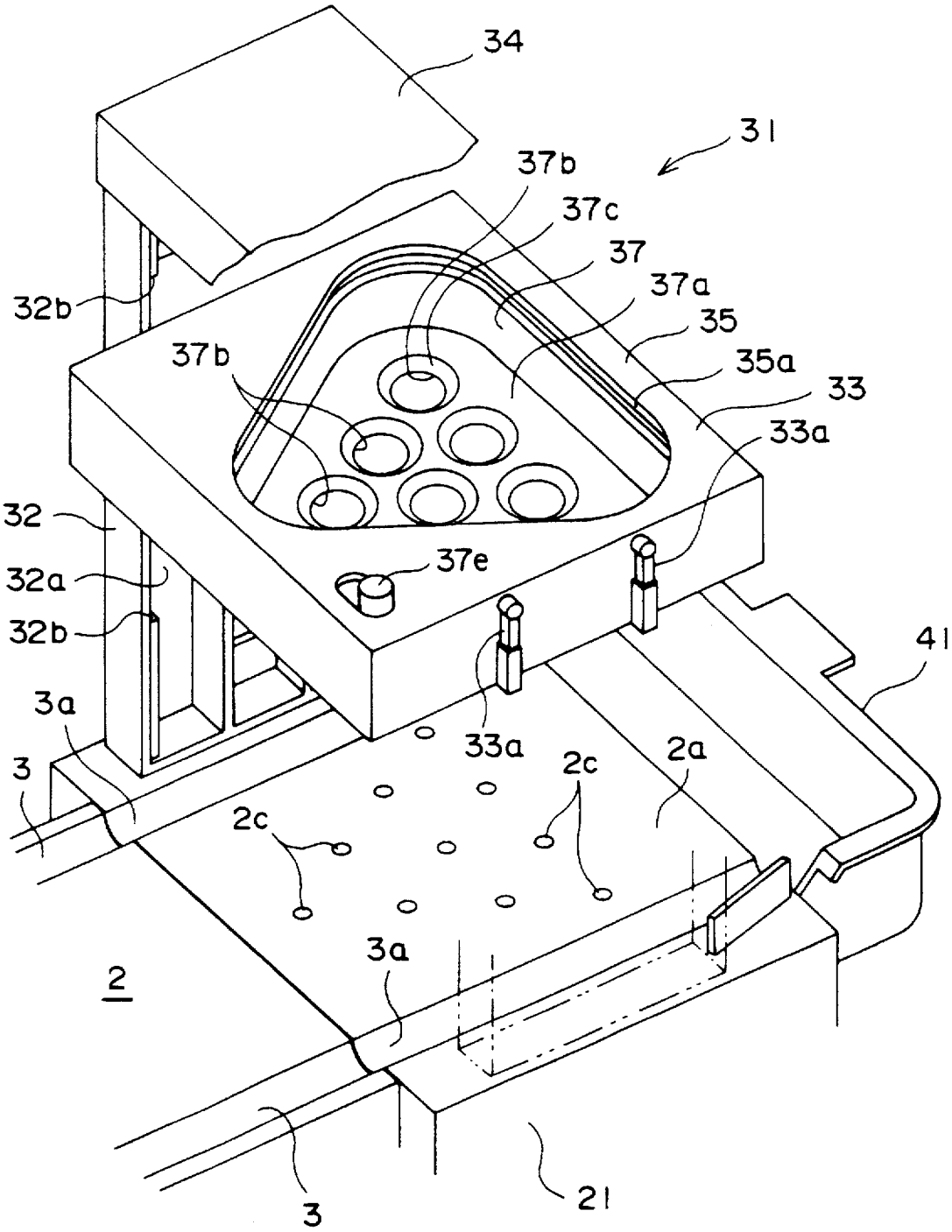
FIG. 2 is a perspective view of a pin stand part and a pin arranging means of FIG. 1.

Referring now to FIG. 2, the pin controller 31 is composed of guide members 32 erected in parallel with parts of the pin stand part 21 which project from both sides of the pin stand surface 2a, pin arranging device 33 which are movable upward/downward along these guide members 32, and a ceiling member 34 fittingly attached to the tops of the guide members 32.

The guide members 32 are fixed to both sides of the pin stand part 21 at lower ends thereof and equipped with guide grooves 32a formed inside thereof in which a pair of guide pins 33a provided on both sides of the pin arranging device 33 slidingly move, and these guide grooves 32a are provided in their upper and lower parts with stoppers 32b.

The pin arranging device 33 is mainly composed of a rectangular device body 35, a throw-in case 37 supported via elastic members 36 (FIG. 3) of rubber or the like by, and located inside of, the device body 35, and a drive means for oscillating the throw-in case 37.

Figure 3:
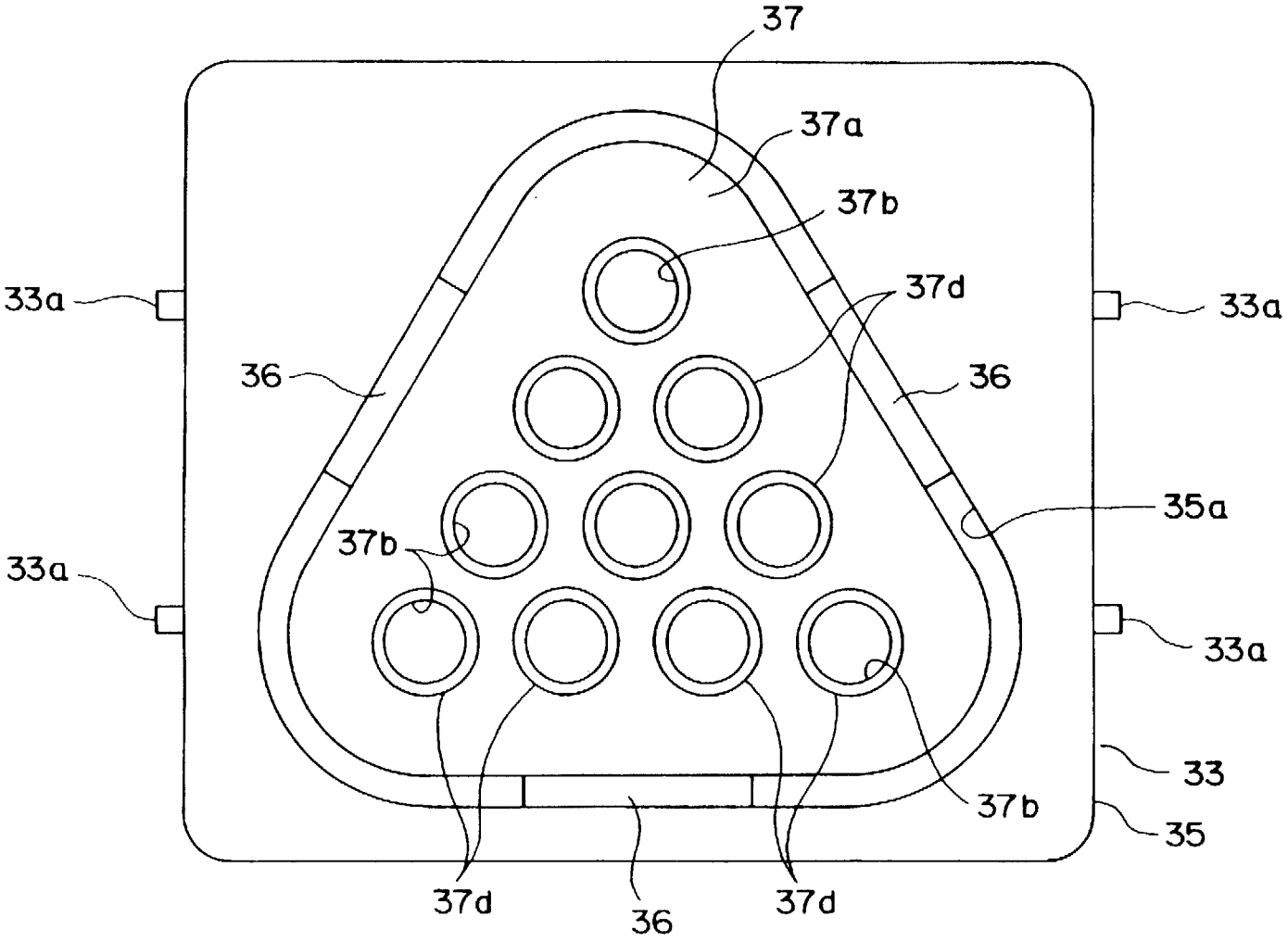
FIG. 3 is a plan view from the bottom side of a pin arranging means of FIG. 1.

A triangular-shaped opening part 35a is formed inside of the device body 35, and the throw-in case 37 formed a size smaller than, and along, the opening part 35a is disposed inside of the opening part 35a. The throw-in case 37 is supported within the device body 35 by the elastic members 36 provided in three directions. The throw-in case 37 is equipped with pitfalls 37b formed in its bottom plate 37a for allowing pins 10 to pass through only in their longitudinal direction. Each of the pitfalls 37b is given a shape facilitating a pin 10 to slip in by forming a chamfered part 37c on its top surface and guide tubes 37d communicating with the pitfalls 37b are attached on the back surface of the bottom plate 37a as shown in FIG. 3, and pins 10 are thereby guided to the engagement holes 2c in the pin stand surface 2a. The bottom part of each of the pins 10 is made heavier by putting therein a weight or the like so as to fall into pitfalls 37b the bottom part foremost.

The device body 35 is equipped with an oscillation generating means (not shown) using a motor and an oscillator, and the throw-in case 37 is oscillated by driving this means. The device body 35 is equipped on its top with a switch 37e of the oscillation generating means.

The pin stand part 21 is equipped on its outer end part with a collecting case 41 for collecting fallen pins 10. The collecting case 41 is removably mounted on an end part of the pin stand part 21.

As the bowling game board as a form embodying the present invention is constituted as described above, firstly the bowler doll 6 is disposed at the most suitable position on the lane 2 while the arm 6a of the bowler doll 6 is rotated and its tip end is locked by the locking part 7, and then a ball 5 is put on the bowl rest part 4a.

Nextly, a locked state of the locking part 7 is released by pushing the push button 8, causing the ball 5 to be thrown, as a first throw, aiming at the pins 10 standing on the pin stand part 21 and arranged in a prescribed formation. The thrown bowl 5 rolls on the lane 2, bringing down pins 10 arranged on the pin stand part 21, and is collected inside the collecting case 41. Otherwise it is collected through the gutter 3.

Figure 4:
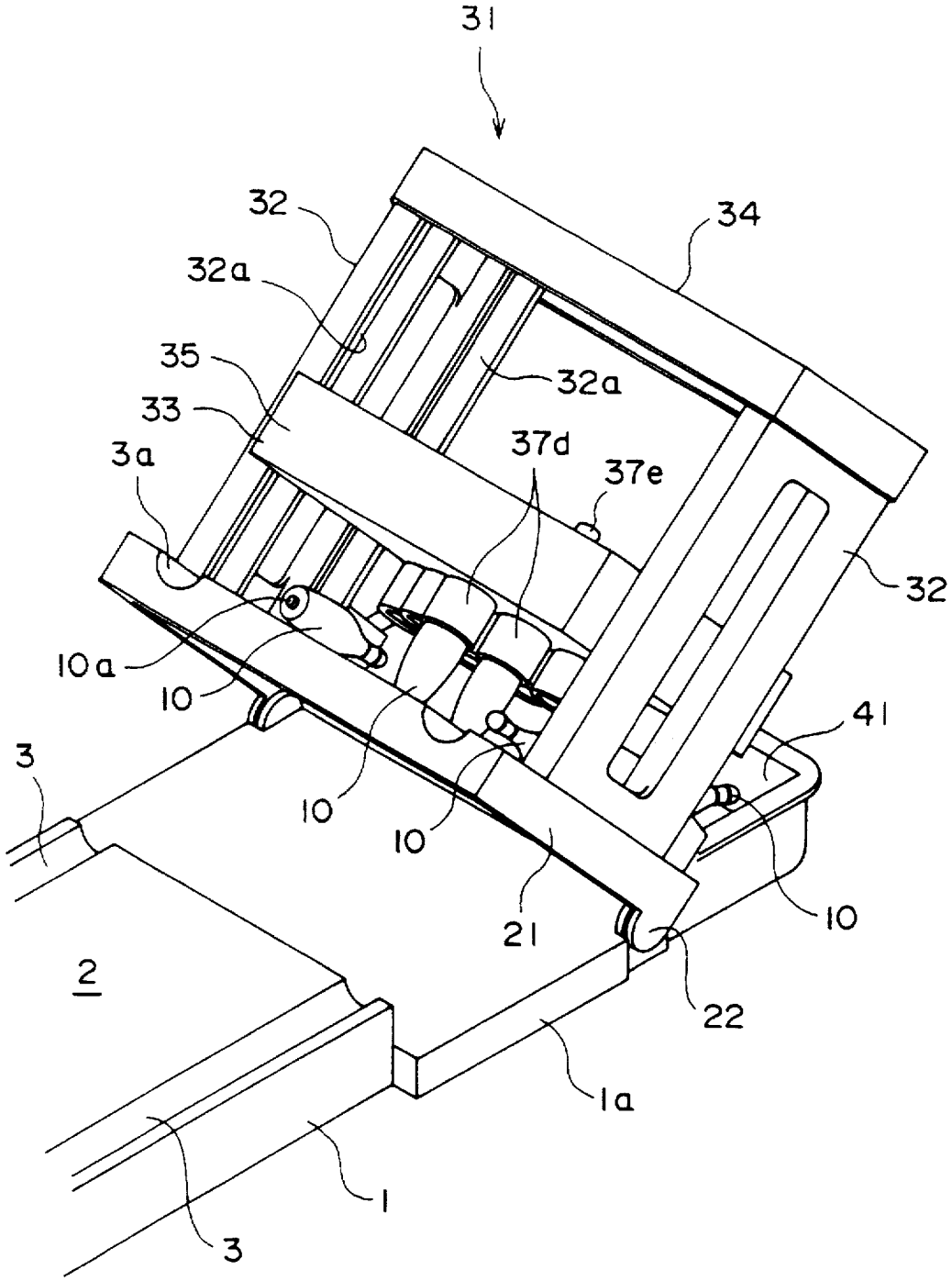
FIG. 4 is an explanatory drawing for explaining a state that pins fallen onto a lane are collected into a collecting case by rotating and tilting a pin stand part of FIG. 1.

Then, if some pins 10 are left unfallen on the pin stand part 21, the standing pins 10 are received within the guide tubes 37d and the pitfalls 37b of the throw-in case 37 by lowering the device body 35 along the guide members 32. This state being kept, only the fallen pins 10 among the standing pins 10 are collected within the collecting case 41 by tilting the pin stand part 21 toward the collecting case 41 with the outer end part 22 fulcrumed, as shown in FIG. 4.

After the fallen pins 10 are collected into the collecting case 41, the pin stand part 21 is returned to its original state and laid on the base board 1, causing the pin stand surface 2a to be flush with the lane 2, and then only the pins 10 held in the pitfalls 37b of the throw-in case 37 get arranged again on the pin stand surface 2a by moving the device body 35 upward along the guide members 32.

Nextly, the ball 5 is thrown as a second throw aiming at the remaining pins 10 to bring down the remaining pins 10. After the second throw, both still standing pins 10 and fallen pins 10 are collected into the collecting case 41 by tilting the pin stand part 21.

The second throw being over and all the pins 10 being collected into the collecting case 41, the collected pins 10 are all thrown into the interior of the throw-in case 37, and thereafter the throw-in case 41 is oscillated by turning on the switch 37e. When the throw-in case 41 oscillates, the pins 10 in the throw-in case 41 begin to dance and come to fall into the interior of the pitfalls 37b the heavier bottom part foremost, then the engagement projections 10a on the bottom part being inserted respectively into the engagement holes 2c in the pin stand surface 2a, and standingly placed there in an arranged state.

This state being kept, the pins 10 are arrangedly set on the pin stand surface 2a, by raising the device body 35 along the guide members 32, and a next game can be resumed.

The present invention comprises; a base board on the top surface of which a lane is formed; a bowler's platform provided on one end of the lane of the base board and attached thereon movably in the width direction; a bowler doll fixed on the top of the bowler's platform and having an arm which rotates by means of restitution force of a spring; a locking part provided in the rear of the arm of bowler doll on the aforesaid bowler's platform for engagingly locking the tip end of the arm and a push button for disengaging the lock of the locking part; a pin stand part provided on the other end side of the base board; a pin controller for causing pins to stand provided above the pin stand part so as to be able to move upward/downward; and a pin collecting case removably attached on the outer end part of the pin stand part; and therefore realism of bowling games is not damaged, a second throw can be continued by removing fallen pins rapidly and surely and by resetting the remaining pins as they originally stood, or a game can be resumed by automatically arranging and standing all pins rapidly and precisely after a second throw is finished or all the pins have fallen by a first throw.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A bowling game comprising:

a base board on the top surface of which a lane is formed for rolling a ball;

a ball delivery device provided on one end of said base board; and a pin controller opposite to said ball delivery device and pivotally connected to said base board, said pin controller comprising a pin stand area supporting an at least one guide member and a pin arranging device supported by said at least one guide member and movable relative to said guide member.

2. The bowling game according to claim 1, wherein said pin arranging device comprises:

a device body supported by, and movable upward/downward along, an at least one guide groove formed in an inner side of said at least one guide member, a pin throw-in case located in the middle of, the device body and provided with pitfalls formed in a bottom part and configured to allow a plurality of pins to pass therethrough longitudinally, and an oscillation generating means for oscillating said throw-in case to spot said plurality of pins.

3. The bowling game according to claim 2, further comprising:

a plurality of pins each equipped on a bottom part with a weight and an engagement projection, wherein said pin stand area defines a plurality of engagement holes configured to receive said engagement projections.

4. The bowling game according to claim 1, further comprising:

a plurality of pins each equipped on a bottom part with a weight and an engagement projection, wherein said pin stand area defines a plurality of engagement holes configured to receive said engagement projections.

5. The bowling game according to claim 1, wherein the pin arranging device is configured to move linearly with respect to said at least one guide member.

6. A bowling game comprising:

a baseboard on the top surface of which a lane is formed for rolling a ball;

a ball delivery device provided on one end of said baseboard; and a pin controller connected to said baseboard opposite to said ball delivery device, said pin controller comprising a throw-in case and an oscillation generating means for oscillating said throw-in case to spot a plurality of pins contained in the throw-in case.

7. The bowling game according to claim 6, further comprising:

a plurality of pins each equipped on a bottom part with a weight and an engagement projection; and a pin stand area which defines a plurality of engagement holes configured to receive said engagement projections.

8. The bowling game according to claim 6, wherein said pin controller is attached pivotally to said base board.

* * * * *